US008387174B1

(12) United States Patent
Gillespie

(10) Patent No.: US 8,387,174 B1
(45) Date of Patent: Mar. 5, 2013

(54) SWIMMING POOL SKIMMER CREATURE RAFT RESCUE DEVICE

(76) Inventor: Nicki Sue Gillespie, Strafford, MO (US)

( * ) Notice: Subject to any disclaimer, the term of this patent is extended or adjusted under 35 U.S.C. 154(b) by 0 days.

(21) Appl. No.: 13/342,124

(22) Filed: Jan. 2, 2012

Related U.S. Application Data

(60) Provisional application No. 61/461,914, filed on Jan. 25, 2011.

(51) Int. Cl.
*E04H 4/00* (2006.01)

(52) U.S. Cl. ..... 4/507

(58) Field of Classification Search ..... 4/488–513; 441/80, 83, 129; 119/706, 416, 452, 843, 119/847, 849, 221–226; 114/362; 14/75; 211/33; 210/169, 236–238, 269, 249, 242.1, 210/470, 473, 167.2
See application file for complete search history.

(56) References Cited

U.S. PATENT DOCUMENTS 3,616,918 A * 11/1971 Diemond et al. ..... 210/167.1
3,625,364 A * 12/1971 La Chance ..... 210/167.2
3,652,090 A * 3/1972 Semmens ..... 273/336
3,780,686 A * 12/1973 Brill ..... 114/267
4,221,662 A * 9/1980 Joseph ..... 210/167.18
4,325,462 A * 4/1982 Gouzos ..... 182/93
4,746,424 A * 5/1988 Drew ..... 210/167.2
4,781,827 A * 11/1988 Shields ..... 210/167.1
4,903,926 A * 2/1990 McNarry et al. ..... 248/214
4,972,540 A * 11/1990 Phelps ..... 14/75
5,043,060 A * 8/1991 Brennan ..... 210/122
5,048,222 A * 9/1991 Correll ..... 43/9.1
5,173,181 A * 12/1992 McFarland ..... 210/167.19
5,275,721 A * 1/1994 Mathews ..... 210/167.19
5,320,568 A * 6/1994 Koerkel, Jr. ..... 441/129
5,377,623 A * 1/1995 Parr ..... 119/221
5,525,217 A * 6/1996 Fulop ..... 210/167.18
5,862,541 A * 1/1999 Mailhot ..... 4/496
D411,670 S * 6/1999 Mapes ..... D32/35
5,919,359 A * 7/1999 Bisseker ..... 210/167.19
D432,206 S * 10/2000 Stoltz et al. ..... D23/209
6,132,604 A * 10/2000 Kirchoff ..... 210/470
6,136,206 A * 10/2000 Butcher et al. ..... 210/776
6,270,683 B1 * 8/2001 Turner ..... 210/776
6,321,689 B1 * 11/2001 Fulmer ..... 119/706
6,358,410 B1 * 3/2002 Lambert ..... 210/238
6,398,952 B1 * 6/2002 Baer ..... 210/167.19
6,532,899 B1 * 3/2003 Hootman ..... 119/253
6,598,562 B1 * 7/2003 Dutkiewicz et al. ..... 119/706
6,643,879 B1 * 11/2003 Davis ..... 14/69.5
6,709,582 B2 * 3/2004 Danner ..... 210/170.02
6,796,864 B1 * 9/2004 Schoos ..... 441/80
7,086,349 B2 * 8/2006 Bagnall ..... 119/253
7,146,658 B2 * 12/2006 Lyall ..... 4/508
7,374,671 B2 * 5/2008 Blake ..... 210/167.19
7,452,460 B2 * 11/2008 Blake ..... 210/167.19
7,523,516 B1 * 4/2009 Waddell et al. ..... 14/69.5
7,550,078 B2 * 6/2009 Meagher ..... 210/167.1
7,972,504 B2 * 7/2011 Weiss ..... 210/167.2
7,984,518 B1 * 7/2011 Jarvis ..... 4/496

OTHER PUBLICATIONS

The Critter Saving Escape Ramp, use & assembly, 2 pp, available online at www.froglog.us ,or from Osprey LLC, 1431 Hoppa Rd., Crownsville, MD 21032 ph. 410-923-9979.

* cited by examiner

*Primary Examiner* — Lori Baker
(74) *Attorney, Agent, or Firm* — Richard L. Marsh

(57) ABSTRACT

A device for rescuing, retrieving and setting free native wildlife caught in a swimming pool skimmer comprises a body and a retrieval apparatus. The body has a base and an elevated surface of lesser external dimensions than a flange of the base. The body has an enclosed volume captured between the base and the elevated surface. The retrieval apparatus is associated with a portion of the body.

17 Claims, 5 Drawing Sheets

SWIMMING POOL SKIMMER CREATURE RAFT RESCUE DEVICE

RELATED APPLICATION DATA

This a non-provisional application of Applicant's provisional application Ser. No. 61/461,914 filed 25 Jan. 2011, the entirety of the specification thereof incorporated into this application by this reference thereto.

BACKGROUND OF THE INVENTION

1. Field of the Invention

This invention relates to a device to rescue, retrieve and set free creatures from a swimming pool skimmer wherein the various creatures have been swept into the skimmer after falling or jumping into the pool.

2. Prior Art Statement

Cleaning a skimmer in a swimming pool is often a dreary and gruesome task as numerous native wildlife creatures have been swept into the skimmer and succumbed to the forceful flow of water through the skimmer basket. Many attempts have been made to permit creatures to survive after entering the pool water, however none of these devices are of use once the creature(s) enter the pool skimmer. That is why a creature raft rescue device should be in all swimming pool skimmers. Upon a reading of this disclosure, it could be assumed that a flat piece of plastic material would serve the purpose of providing a place for native wildlife to rest, however, it has been found by the inventor hereof that a flat piece merely flips over or tilts into the flow of water thus depriving the creature of rescue. Therefore, there is a need for a creature raft rescue device that makes cleaning a swimming pool skimmer a pleasure by rescuing creatures that are swept into the skimmer and setting each free. There is also a need for a creature raft rescue device that teaches humane methods for rescue of native wildlife. The need is great for a creature raft rescue device that floats upon the surface of the skimmer permitting flow of debris into the basket but also has sufficient buoyancy to maintain a proper attitude in the flow of water in the skimmer and for providing a place elevated above the water surface for creatures to access and to rest until rescued.

It is known to provide an apparatus for rescuing frogs from swimming pools that is a plastic pad that attaches to the ladder for in-ground pools wherein the frog can mount the pad and jump out over the edge of the pool. For instance, see the U.S. Pat. No. 5,377,623 issued on 3 Jan. 1995 to Jeffrey A. Parr. As with many prior art devices, the frog must make its way to the pad, mount it and escape of its own volition, however since most frogs are swept into the skimmer, it is reasonable to assume that with this device most frogs will jump back into the pool and perish. Therefore, there is a great need to place a device for rescuing, retrieving and setting free native wildlife into the skimmer. There is also a great need for a simple device for rescuing, retrieving and setting free native wildlife that comprises a base, an elevated surface and a retrieving apparatus.

It is likewise known to provide a simple animal rescue device that comprises a main cross piece having two hook support arms hingedly connected on opposite ends of the cross piece having hooks to engage the outer edge of the swimming pool and a negative buoyancy unit attached to the lower end of a sheeting element depending from the main cross piece. For instance, see the U.S. Pat. No. 6,321,689 issued on 27 Nov. 2001 to Phillip E. Fulmer. No size is given for the device however, placement of multiple devices would be required to provide sufficient opportunities for animals to rescue themselves thus decreasing the swimming area of the pool along the portions where the devices are hooked. As with many other devices, the animal must make its way to the device and climb out though most drown in the skimmer. It might be obvious after reading the description contained in this prior art statement to place the device in front of the skimmer, however, such a placement is not taught by the inventor and the instant inventor has found that netting entraps debris meant for the skimmer. Therefore, there still is a great need for a device for rescuing, retrieving and setting free native wildlife that is hidden in the skimmer and retrieved by the owner or pool servicer.

It is well known to provide an animal escape device for swimming pools that consists of a piece of polyethylene netting 44×46 inches and a water tube, the netting having a sleeve sewn on one end thereof to accept the water tube. The water tube rests on the pool walking surface and the netting draped onto the pool surface. For instance, see the U.S. Pat. No. 6,794,864 issued on 28 Sep. 2004 to Paul Johannes Schoos. Instructions are given to make the device from available pool materials, however, as with other prior art devices, animals must make way to the device to rescue themselves but most drown in the skimmer. It might be obvious after reading the description contained in this prior art statement to place the device in front of the skimmer, and, in fact, the inventor places this device adjacent the skimmer, however, it has been found by the instant inventor that netting in front of the skimmer defeats the purpose of the skimmer. Therefore, there still is a great need for a device for rescuing, retrieving and setting free native wildlife that is hidden in the skimmer and retrieved by the owner or pool servicer.

Another prior art device to provide swimming pool escape ramp for frogs and the like that attaches to the side of the swimming pool. For instance, see the commercially available FrogLog, available from Osprey LLC, 1431 Hoppa Rd, Crownsville, Md. 21032. The FrogLog is a ramp fixed at one end to a weighted bag and at the opposed end with a rectangular float. The rectangular float lies on the surface of the water while the weighted bag rests on the solid surface surrounding the pool. Small native wildlife that have entered the pool must make way to the rectangular float, mount the float and climb the ramp in order to escape the pool. Many other creatures are swept into the skimmer basket where the creatures perish. Additionally, in pool devices will most generally need to be removed during pool use for the safety of the device and for swimmers. Thus, there is a great need for a swimming pool skimmer creature raft rescue device that is hidden in the skimmer and ensures that creatures have a safe place to rest until retrieved by the swimming pool owner.

A further improvement in the art is to provide a swimming pool skimmer well frog rescue device that comprises a ramp mounted to a central post having a foot at a bottom end thereof. The foot rests on the base of the skimmer basket and the ramp is angled upwardly from a position generally coincident with the top of the skimmer basket. For instance, see the U.S. Pat. No. 5,862,541 issued on 26 Jan. 1999 to Louis Mailhot. The device must be forcibly rotated into a position with the base of the ramp oriented toward the skimmer opening and a passage must be provided for frog egress. In the opinion of the instant inventor, there are many parts that can trap debris which makes cleaning of the basket more difficult as well as it does not account for rising water level. Therefore, the need for an animal rescue device that merely floats upon the surface of the water allowing debris to fall below and the device to rise with the water level above the skimmer basket is great. The need for an animal rescue device that comprises a body with a free-form flange wherein the body has an elevated surface still exists.

Additionally, it is known to provide a device for small animal escape from a pool that comprises a mesh ladder ramp positioned sufficiently close to the water surface in the entrance of the skimmer to allow animals to climb the ramp and exit through a hole provided in the walkway at the skimmer. For instance, see the U.S. Patent issued on 20 Apr. 1982 to John Gouzos. The pool walkway must be modified to provide escape of the animal and to hold the upper end of the ramp though there is no means recited for support of the ramp. In the figures, it appears that the upper end of the ramp is rigidly affixed to the sump and thus would prevent removal of the skimmer basket without removal of the ramp. Thus, there is a great need for an animal rescue device that floats upon the surface of the water over the skimmer basket providing a place to rest for animals swept into the skimmer basket until removal by the pool owner or pool servicer. The need for an animal rescue device that does not inhibit cleaning of the skimmer basket is provided with the instant invention.

It is further known to provide a swimming pool animal escape device which comprises a semi-spherical housing symmetrically oriented about a housing axis that includes a cylindrical roof plate orthogonally oriented relative to the axis and fixedly mounted to an annular equatorial periphery of the spherical housing wherein the roofplate is oriented below the water line. For instance, see U.S. Pat. No. 5,320,568 issued on 14 Jun. 1994 to Charles J. Koerkel, Jr. The device is adapted to float freely upon the pool surface thus requiring the animal to be rescued to find the device in order to climb thereupon, however, most animals are swept into the skimmer and thus will perish. In view of the instant invention, it might become obvious to place the device of Koerkel, Jr., into the skimmer to provide for rescue of animals, however due to the circular nature of the device, the instant inventor has found that the cylindrical device will be pushed in against the skimmer wall without an opening on the backside to allow creatures who are sucked under the device to come up on the back side. Thus, there is a need for a swimming pool skimmer creature raft rescue device that is adapted to be placed in the skimmer that will freely float upon the surface of the water over the skimmer basket to allow creatures swept into the skimmer a means for rescue by the pool owner or servicer. Additionally, there is a need for a device having a rectangular shape with a free-form peripheral edge and a retrieval apparatus in order to be more readily accessed by animals in the water.

Finally, it is known to provide a skimmer cover and helical ramp apparatus to allow animals to escape from a pool skimmer through an egress hole formed through the skimmer cover. The ramp is affixed to the skimmer cover and spirals downward to the bottom of the skimmer basket. Animals must find the ramp, climb up the ramp and through the flow of water going into the skimmer basket. For instance, see the U.S. Pat. No. 7,550,078 B2 issued on 23 Jun. 2009 to Brian M. Meagher. It is the opinion of the instant inventor that the force of water flowing onto the ramp and the suction around the lower end of the ramp may prevent animals from climbing the ramp in order to egress resulting in the animals perishing in the skimmer basket. Also, this device requires replacing the existing skimmer cover and will make cleaning debris from the skimmer more difficult due to debris wrapped around the helical ramp. Therefore, it is necessary to provide an animal swimming pool skimmer creature raft rescue device that floats upon the surface of the water over the skimmer basket which is easily accessible for animals to mount and rest that have been swept into the skimmer entrance. The need for a swimming pool skimmer creature raft rescue device that is not attached to any portion of the pool equipment, does not have multiple parts or interfere with the purpose of the skimmer is also great.

SUMMARY OF THE INVENTION

One object of this invention is to provide a device for rescuing, retrieving and setting free native wildlife caught in a swimming pool skimmer that comprises a body and a retrieval apparatus.

Another object of this invention is to provide a device for rescuing, retrieving and setting free native wildlife caught in a swimming pool skimmer that has a base flange and an elevated surface of lesser external dimensions than the base.

One goal of this invention is to provide a device for rescuing, retrieving and setting free native wildlife caught in a swimming pool skimmer that comprises a body and a retrieval apparatus wherein the body has an enclosed volume captured between a base and an elevated surface thereof.

A significant feature of this invention is to provide a device for rescuing, retrieving and setting free native wildlife caught in a swimming pool skimmer that comprises a body and a retrieval apparatus wherein the retrieval apparatus is associated with a portion of the body.

A main purpose of this invention is to provide a device for rescuing, retrieving and setting free native wildlife caught in a swimming pool skimmer that comprises a body and a retrieval apparatus wherein the body has a base and an elevated surface thereof wherein a top surface of the base remains at or above the surface of the water in the skimmer.

A primary principle of this invention is to provide a device for rescuing, retrieving and setting free native wildlife caught in a swimming pool skimmer that comprises a body and a retrieval apparatus wherein the body has a base and an elevated surface thereof wherein a top surface of the base and the elevated surface are textured.

A principal aim of this invention is to provide a device for rescuing, retrieving and setting free native wildlife caught in a swimming pool skimmer that comprises a body and a retrieval apparatus wherein the body has a base and an elevated surface thereof wherein a peripheral edge of the base is in free-form, the free-form peripheral edge breaking up any wave patterns to retain a top surface of the base at or above the surface of the water in the skimmer.

A primary aspect of this invention is to provide a device for rescuing, retrieving and setting free native wildlife caught in a swimming pool skimmer that comprises a body and a retrieval apparatus wherein the body has a free-form flange of a base that provides access to creatures swept into a swimming pool skimmer.

A primary goal of this invention is to provide a device for rescuing, retrieving and setting free native wildlife caught in a swimming pool skimmer that comprises a body and a retrieval apparatus wherein the body has a free-form flange of a base thereof that orients the buoyant device within the swimming pool skimmer.

DESCRIPTION OF THE PREFERRED EMBODIMENTS

Figure 1:
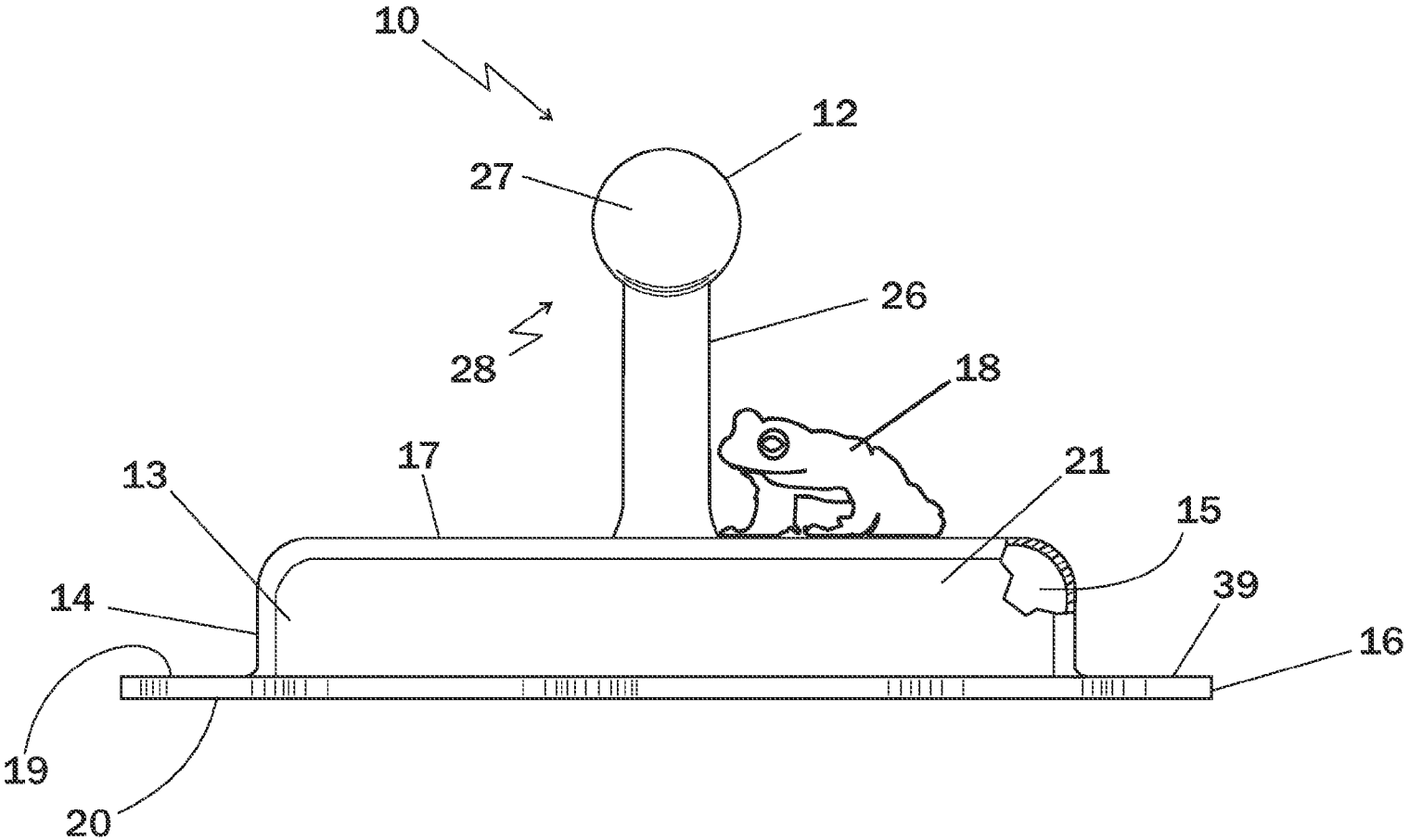
FIG. 1 is a front plan view of the preferred embodiment of the swimming pool skimmer creature raft rescue device of this invention showing the preferred embodiment of the retrieval apparatus associated therewith.

Referring first to FIG. 1, a device for rescuing, retrieving and setting free native wildlife 18 caught in a swimming pool is generally shown by the number 10, device 10 comprising a body 13 and a retrieval apparatus 12. Body 13 has a base 16 and an elevated surface 17 of an inverted cup shape 21, elevated surface 17 of lesser external dimensions than base 16. Body 13 has an enclosed volume 15 captured in inverted cup shape 21 between base 16 and elevated surface 17, enclosed volume 15 providing sufficient buoyancy to device 10 such that a top surface 19 of base 16 remains at or above a water line in a skimmer of a swimming pool. Retrieval apparatus 12 is associated with a portion of body 13 and may consist of various configurations as will become readily apparent hereinafter. In FIG. 1, a portion of a wall 14 of inverted cup shape 21 of body 13 is shown broken away to show enclosed volume 15, it being fully understood that enclosed volume 15 may contain only air or be partially or fully filled with a buoyant substance. In the preferred embodiment, enclosed volume 15 is an empty space capturing ambient air therein upon sealing of enclosed volume 15. Enclosed volume 15 may be formed in several ways as will also become readily apparent hereinafter.

Figure 4:
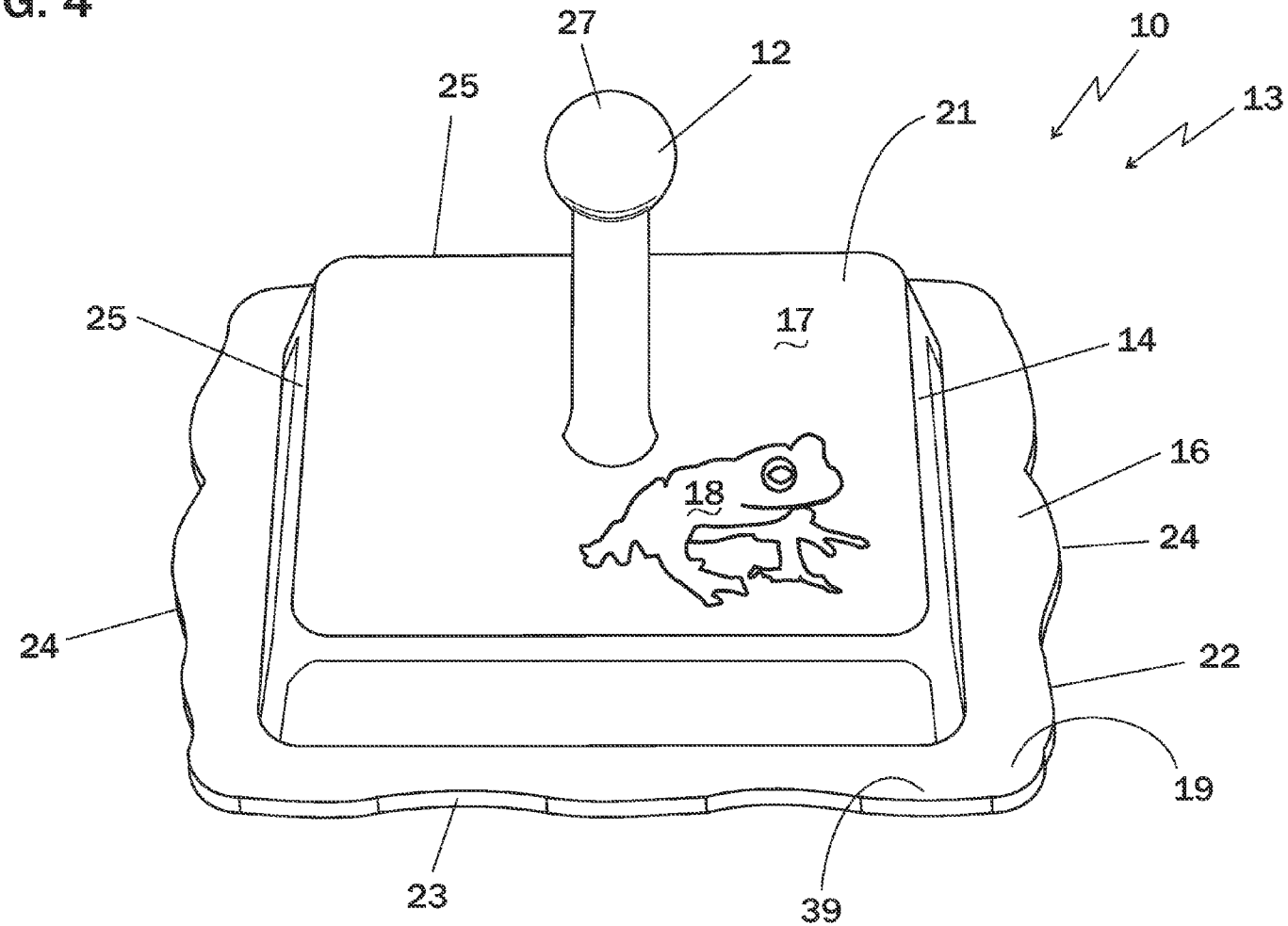
FIG. 4 is a perspective view of the preferred embodiment of the swimming pool skimmer raft rescue device showing a free-form flange of the base thereof.

Referring now also to FIG. 4, a peripheral edge 22 of base 16 has a flange 39 of free-form shape wherein it has been found that free-form peripheral edge 22 of flange 39 is beneficial in retaining top surface 19 of base 16 of device 10 at or slightly above a surface of water within the skimmer area. It is believed that free-form peripheral edge 22 breaks up any standing wave that may form in the water thus keeping top surface 19 substantially level and thus lessens the tendency to be drawn down onto the skimmer basket by the flow of water into the skimmer and around device 10. It is also believed that free-form peripheral edge 22 is more readily accessed by creatures 18 swept into the skimmer by the flow of water thereinto as the buoyancy provided by enclosed volume 15 and free-form peripheral edge 22 work together to keep top surface 19 of base 16 at or just above the water level in the skimmer. Free-form peripheral edge 22 may consist of a plurality of irregular curved sections as generally depicted in FIG. 4, however free-form peripheral edge 22 may be various polygonal shaped notches and teeth which may also be combined with irregular curves. It has been observed by the inventor hereof that mostly rectangular shape with a free-form peripheral edge 22 is significantly more accessible by creatures 18 than a regularly curved edge thus improving capture and retrieval of animals over the circular base of U.S. Pat. No. 5,320,568 thus achieving one object of this invention. As can be readily observed, device 10 is generally rectangular though other polygonal shapes are fully within the scope of this invention. It is also within the scope of this invention to provide for one polygonal shape for base 16 and a different polygonal shape for inverted cup shape 21. For instance, base 16 may be rectangular having two sides 23 thereof of greater length than the two ends 24 while all sides 25 of inverted cup shape 21 are of the same length. It is even within the scope of this invention to provide a substantially circular inverted cup shape 21 superimposed upon a polygonal base 16. As device 10 is generally rectangular, it is also believed that device 10 will remain generally oriented in the alignment with the skimmer as was present at placement of device 10 upon the surface of the water in the skimmer. Though device 10 may rotate within the skimmer, it is believed that the polygonal shape and free-form peripheral edge 22 prevent device 10 from blocking access to creature 18 when device 10 is pushed against any wall surface of the skimmer. Additionally, it has been found that free-form peripheral edge 22 does not allow debris such as leaves, grass and the like to cling to free-form peripheral edge 22 and thus free-form peripheral edge 22 allows debris carried by the water into the skimmer to flow directly into the skimmer basket below device 10.

Figure 2:
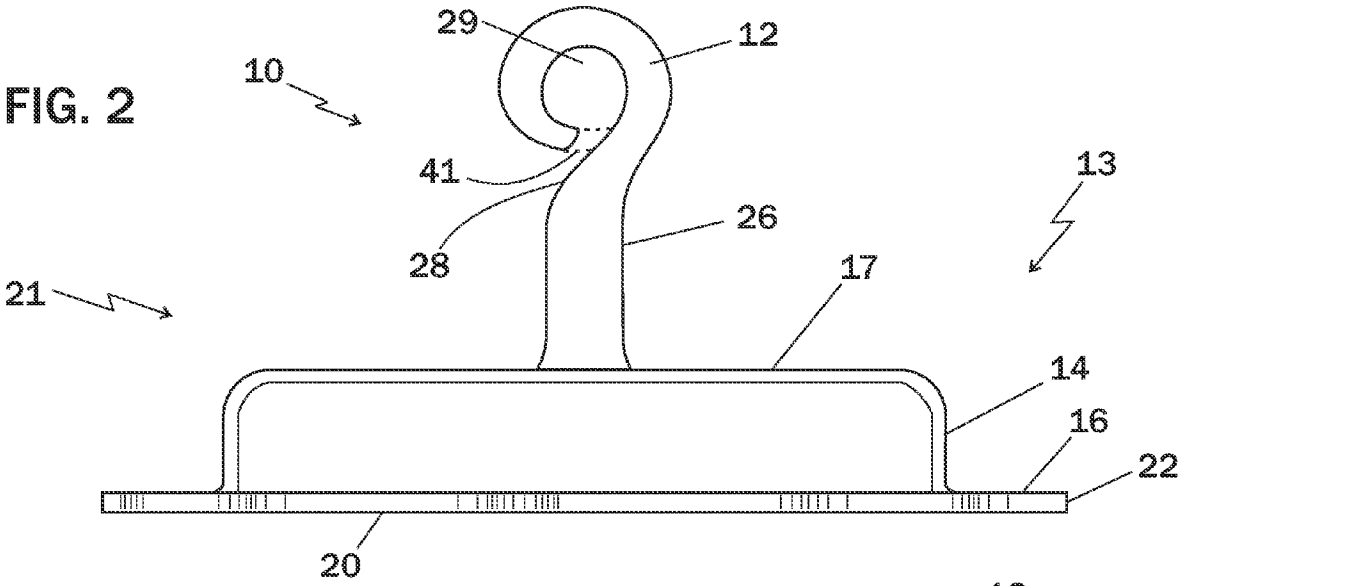
FIG. 2 is a plan view of the preferred embodiment showing another embodiment of the retrieval apparatus associated therewith.
Figure 3:
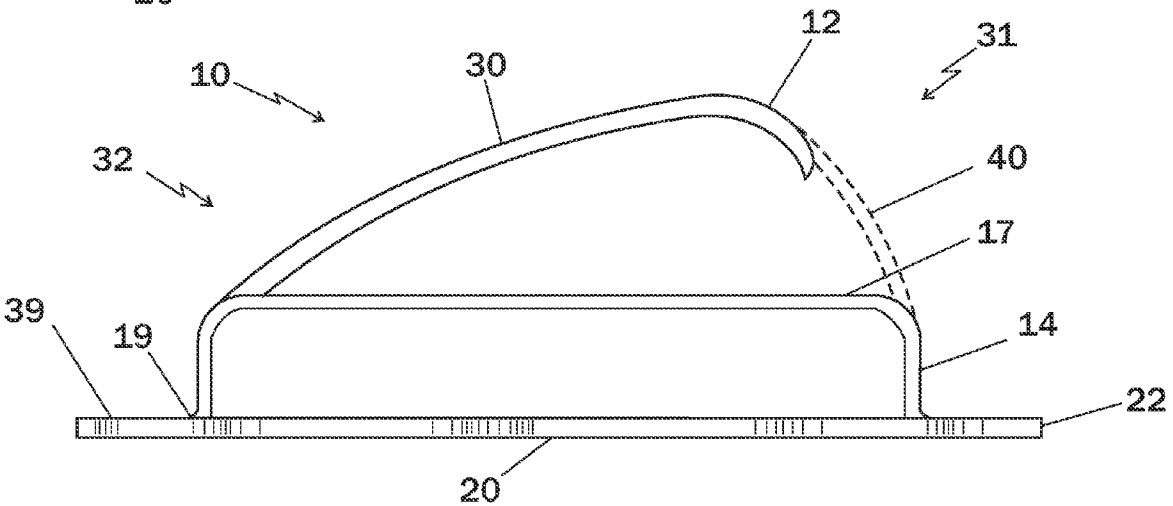
FIG. 3 is plan view of the preferred embodiment showing a third embodiment of the retrieval apparatus associated therewith.

Now referring to FIGS. 1-4, elevated surface 17 provides a place for native wildlife 18 to rest after gaining access to elevated surface 17 from base 16, native wildlife 18 resting thereupon until the skimmer well cover is removed and device 10 lifted therefrom. Elevated surface 17 is elevated above top surface 19 of base 16 by walls 14 wherein walls 14 may be essentially vertical as shown in FIGS. 1-3 or may be disposed at any angle relative to top surface 19 and/or elevated surface 17, however, preferably walls 14 are sloped upwardly from top surface 19 at an angle of up to 45 degrees and most preferably at an angle of about 75 degrees thus maximizing the surface area of elevated surface 17. Preferably, all edges of junctures between walls 14, elevated surface 17 and base 16 are radiused though it should be fully understood that it is within the scope of this invention to make these junctures as desired by the manufacturer thereof. Furthermore, it is preferred that elevated surface 17, top surface 19 of base 16 and side walls 14 ascending from top surface 19 of base 16 to elevated surface 17 are provided with gripping surface elements such that native wildlife 18 have a textured surface for greater gripping while climbing aboard and while resting thereupon. Of course, it is fully within the scope of this invention to omit gripping surfaces from any or all of elevated surface 17, top surface 19 of base 16 and walls 14. Gripping surface elements may be provided as part of the raw material, created during a forming process or applied to selected surfaces 14, 17, 19, 20, 21 of device 10 upon completion of forming.

Still referring to FIGS. 1-4, device 10 is provided with retrieval apparatus 12, retrieval apparatus 12 preferably associated with elevated surface 17. Retrieval apparatus 12 may be a simple knob 27 on an upright post 26 as shown in FIGS. 1 and 4, upright post 26 and knob 27 of a total length to prevent contact with the underside of the skimmer well cover thus allowing device 10 to float free upon the surface of the water. Upright post 26 is preferably centrally located on elevated surface 17 such that device 10 may be easily raised from the skimmer well and maintained at a substantially level attitude while carrying native wildlife 18 thereupon. Upright post 26 may be integrally formed with elevated surface 17 of device 10, permanently attached thereto upon completion of body 13 or made to be removable therefrom. Likewise, knob 27 may be integrally formed with upright post 26, permanently attached thereto upon completion of upright post 26 or made to be removable therefrom. In the embodiment shown in FIG. 2, retrieval apparatus 12 comprises a hook eye 29 formed in an upper end 28 of upright post 26, hook eye 29 adapted to be engaged by a finger of the retriever's hand or a hook of a pole. Hook eye 29 may be open as shown in FIG. 2 or fully closed as shown by dashed lines 41. It is also within the scope of this invention to provide hook eye 29 in knob 27 thus combining the features of FIGS. 1 and 2. Referring now to FIG. 3, retrieval apparatus 12 may comprise a handle 30, handle 30 being integrally formed with elevated surface 17 of body 13, permanently attached thereto upon completion of body 13 or made to be removable therefrom by means known in the art. Handle 30 may be open on one end 31 as shown in FIG. 3, or end 31 may extend to a position directly opposite an attached end 32, as shown with dashed lines 40, wherein end 31 is then integrally formed with elevated surface 17, made removable therefrom or be permanently affixed upon completion of body 13. Handle 30 provides means for the rescuer to balance the weight of device 10 and all creatures 18 thereupon while removing device 10 from the skimmer well.

Figure 5:
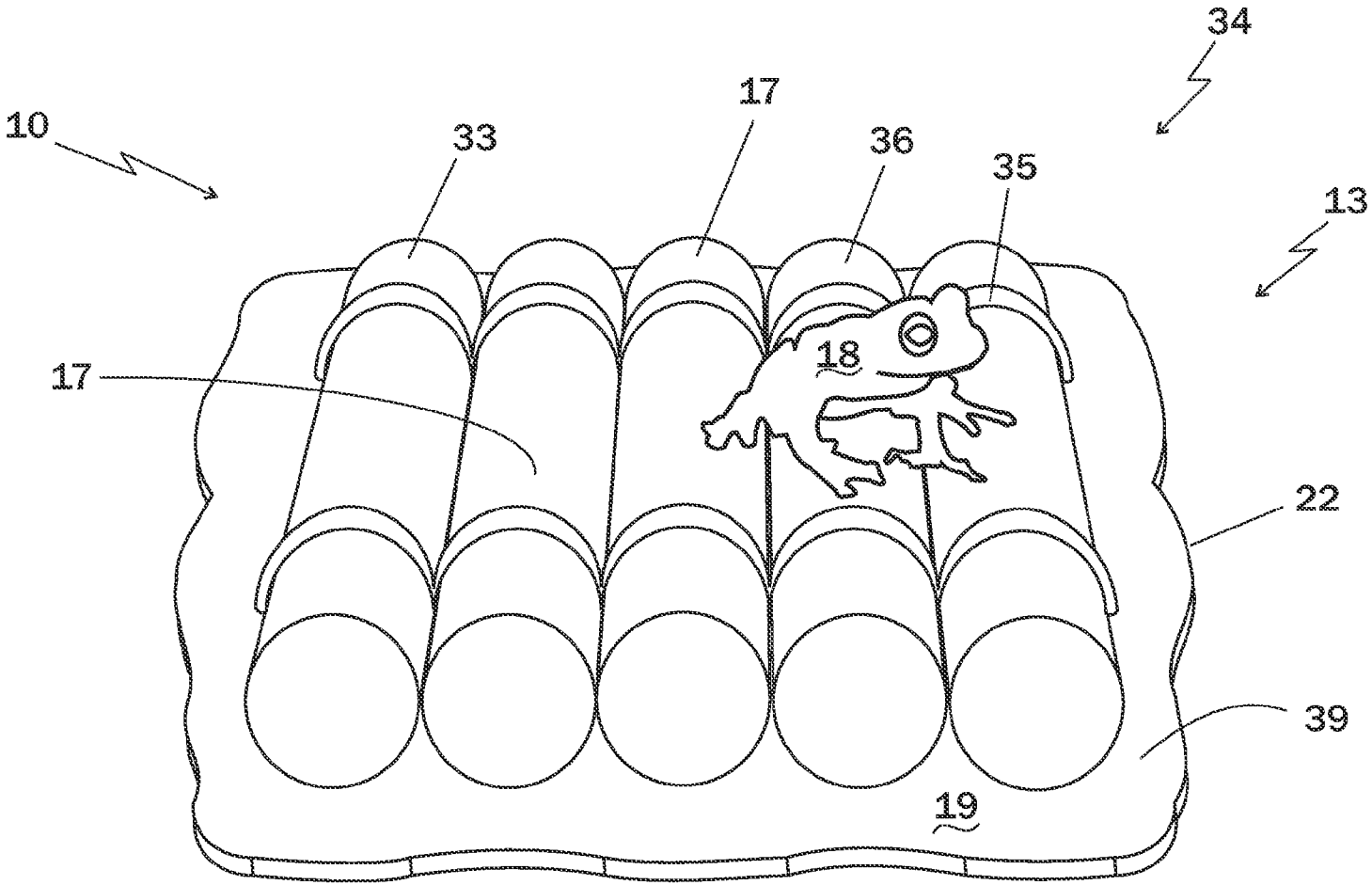
FIG. 5 is a perspective view of an alternative embodiment of the swimming pool skimmer raft rescue device showing a decorative elevated surface.

Referring now to FIG. 5, elevated surface 17 is a decorative surface comprising a plurality of substantially cylindrical objects 33 representing logs 36 joined together with simulated rope 35 to simulate a log raft 34. Logs 36 may be further textured to simulate bark on logs 36 thus providing greater gripping surface for native wildlife 18. Log raft 34 may appear to native wildlife as a familiar object and thus entice the creature 18 to mount log raft 34 of device 10. Texturing on elevated surface 17 may be randomly placed indentations into elevated surface 17, randomly placed raised bumps on elevated surface 17, regular or random striations which may include longitudinal lines, transverse lines, irregular lines, cross hatching or combinations thereof.

Figure 6:
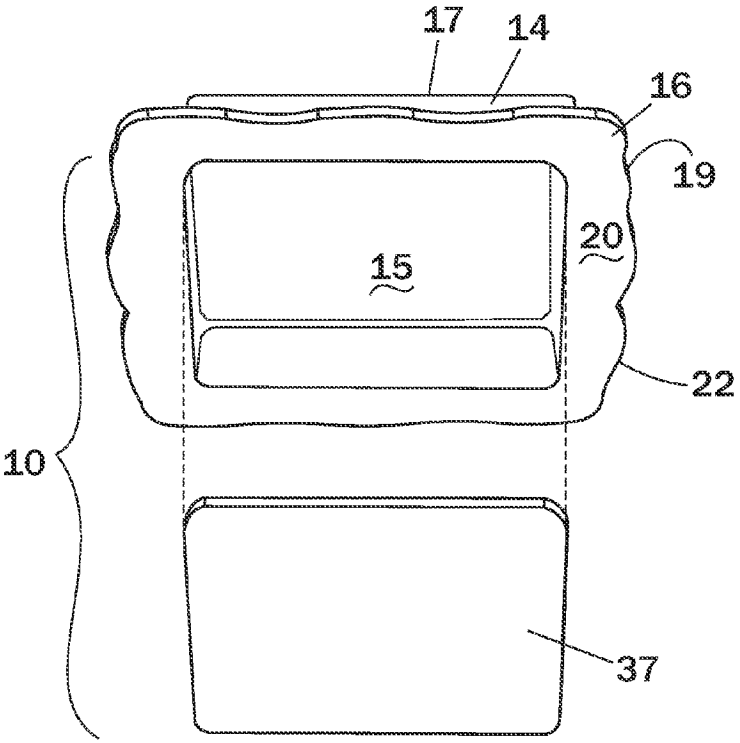
FIG. 6 is a bottom perspective view of the preferred embodiment of the swimming pool skimmer raft rescue device showing a sealing plate separated from a bottom surface of the device.

Referring now to FIG. 6, inverted cup shape 21 and base 16 are preferably integrally vacuum formed with inverted cup shape 21 sealed into bottom surface 20 of base 16 with a flat plate 37 and a water tight sealant. Sealing of inverted cup shape 21 with flat plate 37 and sealant produces enclosed volume 15 providing the requisite buoyancy to device 10. Enclosed volume 15 may be filled with a foamed material prior to sealing with flat plate 37, however, it has been found by the inventor hereof that enclosed volume 15 sealed with ambient air provides sufficient buoyancy for device 10. In the preferred embodiment, device 10 comprises inverted cup shape 21 measuring approximately three and one-half inches by four and one-half inches by three quarters inch deep surrounded by flange 39 of base 16 averaging about one-half inch in width wherein inverted cup shape 21 is sealed with flat plate 37. Body 13 and base 16 are preferably vacuum formed over a form from polymeric materials selected from the group comprising acrylic, butyl, chloroprene, dicyclopentadiene, epoxy, ethylene-methyl acrylate, ethylene-ethyl acrylate, ethylene propylene polymer, ethylene-vinyl acetate, fiberglass, isophthalic polyester, isoprene, methylmethacrylate, oriented polyethylenes, orthophthalic polyester, polyethylene, polyesters, polyamides, polycarbonate, polypropylene, polyvinyl chloride, polystyrene, polytetrafluoroethylene, polyamide, polyparabenzamide, silicone, terephthalic polyester, urethane, vinyl, vinyl ester, viton, wood or combinations or blends of the above. Flat plate 37 is cut from a section of the same raw material and may be sealed into bottom surface 20 by adhesive bonding such as solvent welding, gluing, ultrasonic welding or the like. Upright post 26 and knob 27 of retrieval apparatus 12 may also be formed from rod or tube stock of the same or complementary material as body 13, base 16 and flat plate 37 and affixed to elevated surface 17 by any of the above described attachment means. Though the embodiment described was chosen to provide the best illustration of the principles of the invention and its practical application and to enable one of ordinary skill in the art to utilize the invention, various modifications are within the scope of this invention that may be suited to the particular use contemplated.

Figure 7:
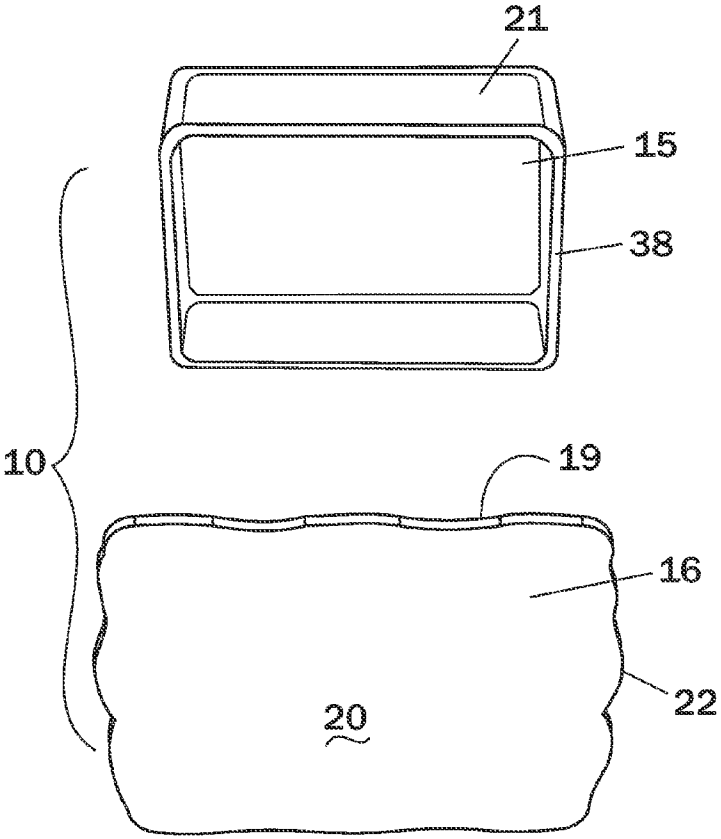
FIG. 7 is a bottom perspective view of an alternative embodiment of the swimming pool skimmer raft rescue device showing an inverted cup shape separated from a base of the device.

Referring now to FIG. 7, inverted cup shape 21 and base 16 may be separately formed wherein base 16 is sealed at interface 38 with hollow vacuum formed inverted cup shape 21 thus negating the secondary process of forming flat plate 37 and affixing same onto the hole formed into bottom surface 20 of base 16 in the preferred embodiment. Retrieval apparatus 12 may be provided in the same manner as described above. Again, inverted cup shape 21 may be filled with a buoyancy material formed by foaming polymeric materials selected from the group comprising acrylic, butyl, chloroprene, dicyclopentadiene, epoxy, ethylene-methyl acrylate, ethylene-ethyl acrylate, ethylene propylene polymer, ethylene-vinyl acetate, fiberglass, isophthalic polyester, isoprene, methylmethacrylate, oriented polyethylenes, orthophthalic polyester, polyethylene, polyesters, polyamides, polycarbonate, polypropylene, polyvinyl chloride, polystyrene, polytetrafluoroethylene, polyamide, polyparabenzamide, silicone, terephthalic polyester, urethane, vinyl, vinyl ester, viton, wood or combinations or blends of the above.

In an another alternate embodiment, device 10 may be blow molded from one of the selected materials into a mold of complementary shape. By blow molding, retrieval apparatus 12, body 13 and base 16 are integrally formed thus obviating the necessity of attaching retrieval apparatus 12 or sealing inverted cup shape 21 with flat plate 37 and a sealant.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A device for rescuing, retrieving and setting free live native wildlife caught in a swimming pool skimmer comprises a body and a retrieval apparatus, said body having a base and an elevated surface, said base having a free-form flange, said elevated surface of lesser external dimensions than said free-form flange, said body having an enclosed volume captured between said base and said elevated surface, said retrieval apparatus associated with said body wherein said enclosed volume provides sufficient buoyancy maintaining said device at a substantially level attitude within said skimmer basket, said free-form flange breaks up wave patterns in water flowing in said swimming pool skimmer thus retaining a top surface of said base at or above a surface of said water in said swimming pool skimmer.

2. A device for rescuing, retrieving and setting free native wildlife caught in a swimming pool skimmer as in claim 1 wherein said enclosed volume is captured in an inverted cup shape affixed to said top surface of said base.

3. A device for rescuing, retrieving and setting free native wildlife caught in a swimming pool skimmer as in claim 2 wherein said enclosed volume in said inverted cup shape is filled with air.

4. A device for rescuing, retrieving and setting free native wildlife caught in a swimming pool skimmer as in claim 1 wherein said enclosed volume is captured in an inverted cup shape formed into a bottom surface of said base.

5. A device for rescuing, retrieving and setting free native wildlife caught in a swimming pool skimmer as in claim 4 wherein said enclosed volume in said inverted cup shape is filled with a buoyant material.

6. A buoyant rescue device adapted to float in a swimming pool skimmer comprises a substantially rectangular device having a free-form flange, a water-tight enclosed volume, an elevated surface and a retrieval apparatus, said free-form flange disposed on an outer periphery of a base of said rectangular device, said water-tight enclosed volume enclosed between said free-form flange and said elevated surface, a top surface of said free-form flange maintained at or above a water level of said swimming pool skimmer by said buoyancy of said water-tight enclosed volume and wherein said free-form flange orients said buoyant device within said swimming pool skimmer and maintains said top surface of said free-form flange essentially level by breaking up wave forms in a flow of said water in said swimming pool skimmer.

7. A buoyant rescue device as in claim 6 wherein said free-form flange is of greater external dimensions than said elevated surface of said water-tight enclosed volume.

8. A buoyant rescue device as in claim 7 wherein said free-form flange provides access to creatures swept into said swimming pool skimmer.

9. A buoyant rescue device as in claim 8 wherein said free-form flange orients said buoyant device within said swimming pool skimmer.

10. A buoyant rescue device as in claim 9 wherein said elevated surface is textured.

11. A buoyant rescue device as in claim 10 wherein said top surface of said free-form flange is textured.

12. A buoyant rescue device as in claim 11 wherein side walls ascend from said free-form flange to said elevated surface.

13. A buoyant rescue device as in claim 12 wherein said side walls are textured.

14. A buoyant rescue device as in claim 13 wherein said retrieval apparatus comprises an upright post and a terminal knob, said post affixed to said elevated surface.

15. A buoyant rescue device as in claim 12 wherein said retrieval apparatus comprises a curved handle affixed to said elevated surface.

16. A method of forming a buoyant rescue device adapted to float in a swimming pool skimmer comprises the step of forming a substantially rectangular piece of a material selected from the group consisting of acrylic, butyl, chloroprene, dicyclopentadiene, epoxy, ethylene-methyl acrylate, ethylene-ethyl acrylate, ethylene propylene polymer, ethylene-vinyl acetate, fiberglass, isophthalic polyester, isoprene, methylmethacrylate, oriented polyethylenes, orthophthalic polyester, polyethylene, polyesters, polyamides, polycarbonate, polypropylene, polyvinyl chloride, polystyrene, polytetrafluoroethylene, polyamide, polyparabenzamide, silicone, terephthalic polyester, urethane, vinyl, vinyl ester, viton, wood or combinations or blends of the above having a free-form periphery, the step of forming an elevated surface onto said piece of material wherein said elevated surface is of lesser orthogonal dimensions than said piece of material thus creating a free-form flange around said elevated surface, the step of enclosing a volume between said free-form flange and said elevated surface wherein said volume is water-tight, the step of texturing at least a portion of said elevated surface and said free-form flange and the step of associating a retrieval apparatus with said buoyant rescue device wherein said enclosed volume maintains a top surface of said free-form flange disposed at or above a water level of said swimming pool skimmer.

17. A buoyant rescue device made by the method of claim 16 for rescuing, retrieving and setting free live creatures swept into a swimming pool skimmer.

* * * * *